US009576506B2

(12) United States Patent
Wilkinson, Jr.

(10) Patent No.: US 9,576,506 B2
(45) Date of Patent: Feb. 21, 2017

(54) DECORATIVE STRUCTURE AND METHOD FOR SAME

(71) Applicant: EPS Specialties Ltd, Inc., Cincinnati, OH (US)

(72) Inventor: Edgar L. Wilkinson, Jr., Cincinnati, OH (US)

(73) Assignee: EPS Specialties Ltd., Inc., Cincinnati, OH (US)

( * ) Notice: Subject to any disclaimer, the term of this patent is extended or adjusted under 35 U.S.C. 154(b) by 0 days.

(21) Appl. No.: 14/484,485

(22) Filed: Sep. 12, 2014

(65) Prior Publication Data

US 2016/0078786 A1 Mar. 17, 2016

(51) Int. Cl.
*G09F 1/06* (2006.01)

(52) U.S. Cl.
CPC ..... *G09F 1/06* (2013.01)

(58) Field of Classification Search
CPC ..... G09F 1/06; B65D 11/1833; B65D 15/24; B65D 7/30; B65D 7/32; B65D 9/24
USPC ..... 220/7, 6, 692, 693
See application file for complete search history.

(56) References Cited

U.S. PATENT DOCUMENTS

| | | | | |
|---|---|---|---|---|
| 1,003,508 | A | 9/1911 | Price | |
| 1,045,815 | A | 12/1912 | Courville | |
| 2,595,633 | A | 5/1952 | Black | |
| 3,456,701 | A | 7/1969 | Cornell | |
| 3,749,343 | A | 7/1973 | Marschak | |
| 3,999,236 | A | 12/1976 | Macauley | |
| 4,010,865 | A * | 3/1977 | Wilgus | 220/6 |
| 4,421,366 | A | 12/1983 | Niziol | |
| 4,779,751 | A * | 10/1988 | Munroe | B65D 5/448 217/69 |
| 5,115,616 | A | 5/1992 | Nixon | |
| 5,413,834 | A | 5/1995 | Hunter et al. | |
| 5,425,520 | A | 6/1995 | Masumoto | |
| 7,125,196 | B2 | 10/2006 | Hinsberger et al. | |
| 7,685,792 | B2 | 3/2010 | Stahl, Sr. et al. | |
| 2001/0019056 | A1* | 9/2001 | Rosenfeldt | 220/7 |
| 2011/0255937 | A1 | 10/2011 | Singer | |

FOREIGN PATENT DOCUMENTS

| | | | |
|---|---|---|---|
| DE | 29512938 | U1 | 3/1996 |
| FR | 2230889 | A1 | 12/1974 |
| GB | 2240375 | A | 7/1991 |

* cited by examiner

*Primary Examiner* — Stephen Castellano
(74) *Attorney, Agent, or Firm* — Wood Herron & Evans LLP

(57) ABSTRACT

A structure is configured to be flat in an unassembled position and to form a three-dimensional structure in an assembled position. The structure includes a plurality of adjacent panels coupled together along fold lines with each panel including a foam core covered on one surface by a flexible skin. The flexible skin is continuous between the adjacent panels that are coupled together for forming a respective fold line for the adjacent panels to be brought together at a right angle to each other along the fold line. The foam core of each panel includes a mitered surface along abutting edges to form a miter joint when adjacent panels are brought together. Slots are formed in the panel cores adjacent to mitered surfaces. Brackets span a miter joint between adjacent panels, holding the spanned miter joint and panels together in a three-dimensional structure.

18 Claims, 10 Drawing Sheets

DECORATIVE STRUCTURE AND METHOD FOR SAME

FIELD OF INVENTION

This invention relates to apparatus and method for forming a structure that might be suspended from a ceiling surface for decorative purposes, signage, displays trellises and the like. More specifically, it relates to structure for providing a three-dimensional platform used to decorate a space or advertise or identify merchandise within a building interior environment.

BACKGROUND OF THE INVENTION

Structures are commonly used in retail environments to identify and promote merchandise or generally decorate a space. For example, structures such as interior signage or Point of Purchase (POP) displays are arranged in the interior of a building. Such structures are an effective way to display graphics and capture the attention of retail customers and make a particular product stand out, thereby increasing sales of that product. Also, structures like a trellis may be used to fill in large open spaces, such as in big box stores, to bring the space in or provide a desired aesthetic effect. Such structures and displays may be permanent or temporary, depending on the nature of the promotion. A structure that will be in place for a significant amount of time is typically considered a permanent display, and may be used to promote or advertise items that are sold on a more or less ongoing basis. Because permanent displays are intended to remain in place for an extended period, permanent displays may be constructed using methods and materials that are relatively labor and cost intensive to produce a durable display.

Various such structures are often part of a ceiling environment and are suspended or otherwise supported above a floor space. Permanent ceiling structures are often heavy and therefore require significant structure to support them from a ceiling surface. It therefore takes additional time and costs to prepare the suspension system for such structures and displays, in addition to assembling or building the actual structure or display itself.

In contrast, a structure or display that is expected to have an in-building life that is more temporary, and is typically considered to be a temporary structure that will be changed more frequently. Temporary structures may be used when the volume of expected sales of the merchandise being promoted is uncertain, such as when introducing a new line of products, or for seasonal products and for products associated with current vendor promotions. Because the lifespan of a temporary structure is limited, it is preferable to have temporary structures that are relatively inexpensive to set up and tear down and/or change. Moreover, due to the frequency with which temporary structures are changed, temporary structures are preferably configured to be changed quickly during off hours or when the store is closed to minimize the disruption to customers. As such, for temporary structures that are suspended from a ceiling, it is not desirable to have a structure that is complicated to build or is heavy or one that requires significant work to a ceiling surface or a costly suspension system to support.

Thus, there is a need for an apparatus and method that provides a robust ceiling structure or display that can be readily and cost-effectively suspended from a ceiling and that can be quickly and easily erected and torn down or changed so that it is suitable for both permanent and temporary displays.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
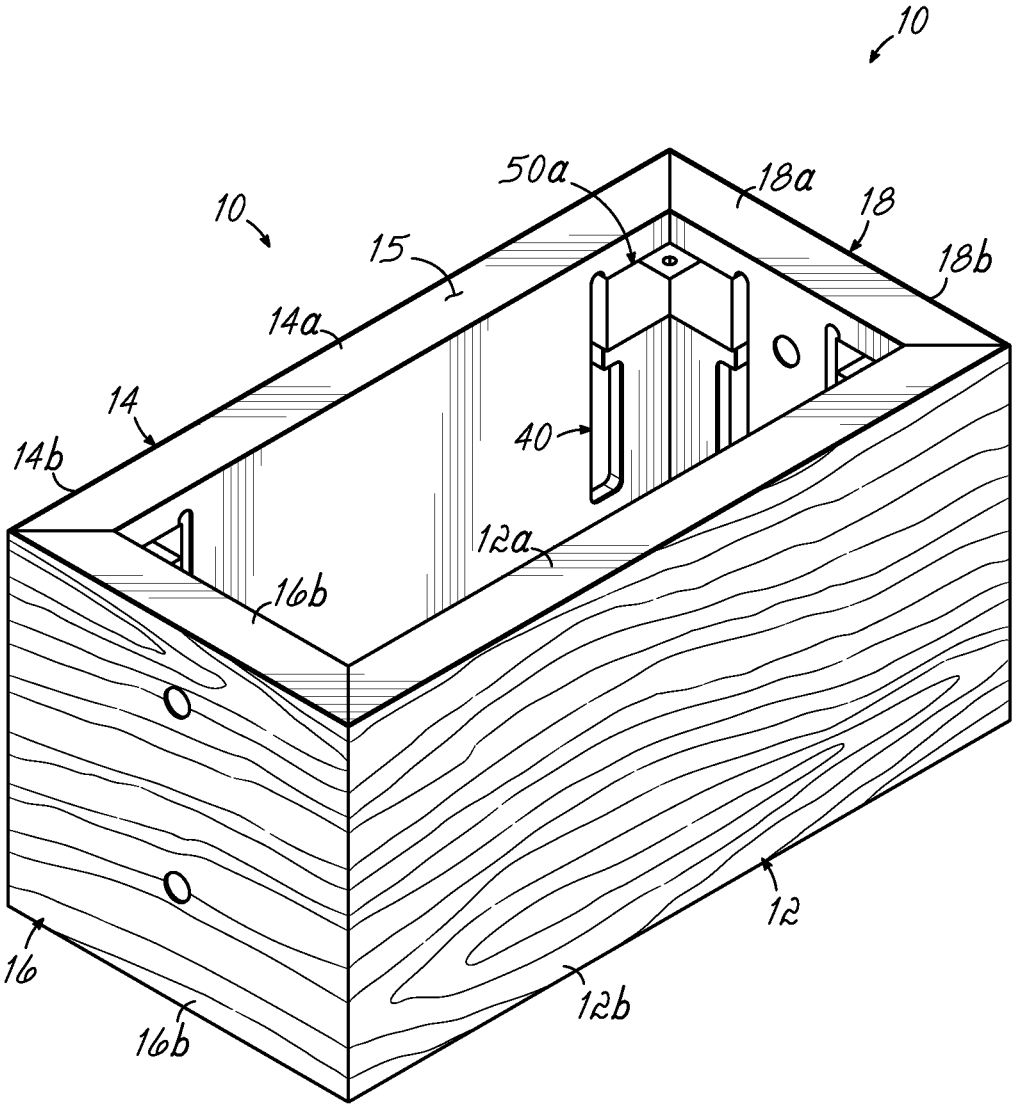
FIG. 1 is a perspective view of an embodiment of the structure of the present invention.

FIG. 1 illustrates a structure 10 in accordance with one aspect of the invention. Structure 10 is shown in an assembled position as a three-dimensional structure, but is able to be laid flat in an unassembled position, such as for shipment and/or storage. As illustrated herein, the flat, unassembled structure in the form of a blank may lay flat and be folded along fold lines to form the three-dimensional structure 10 illustrated in FIG. 1.

Figure 6:
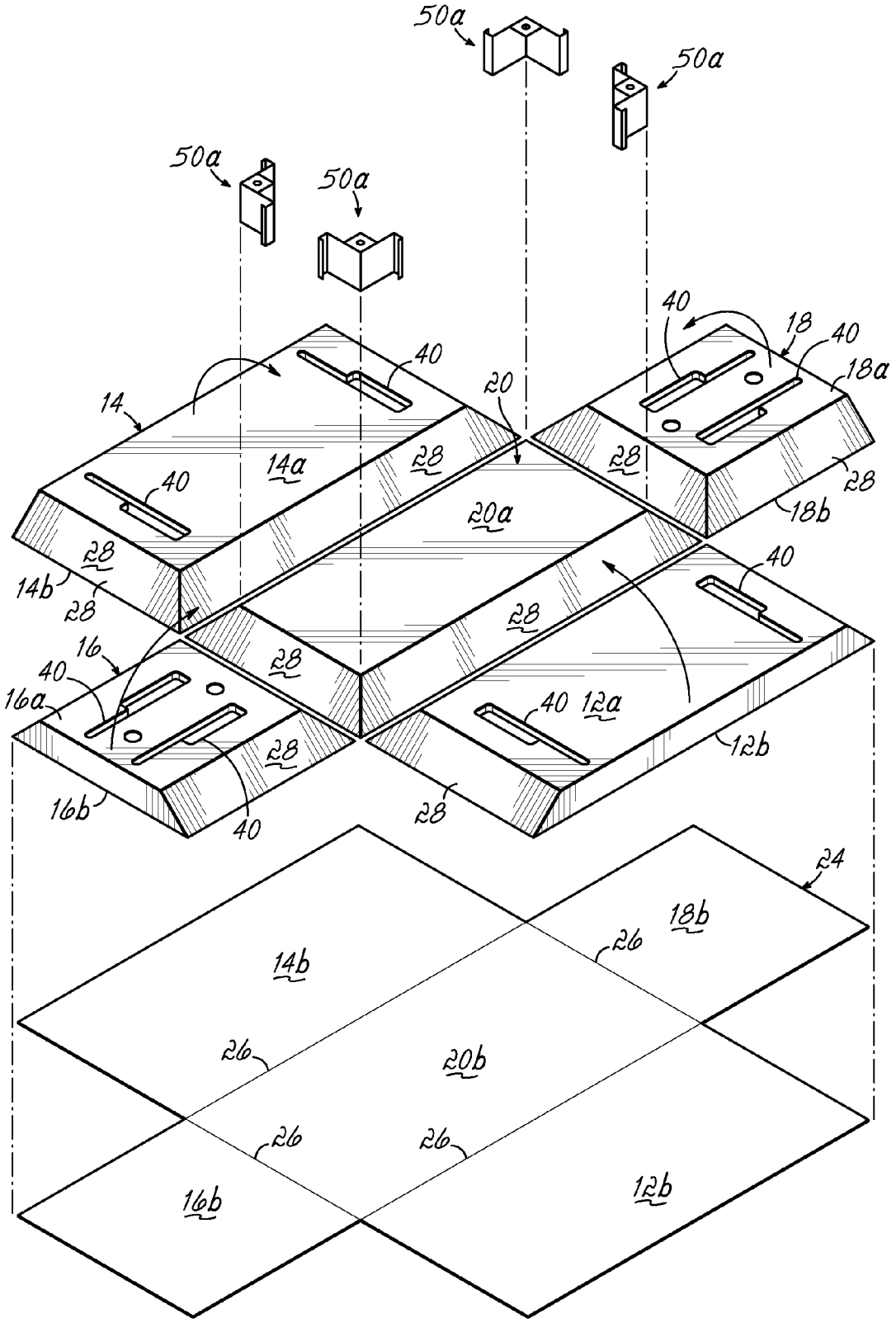
FIG. 6 is an exploded view of portions of the structure in accordance with one embodiment of the invention.
Figure 7:
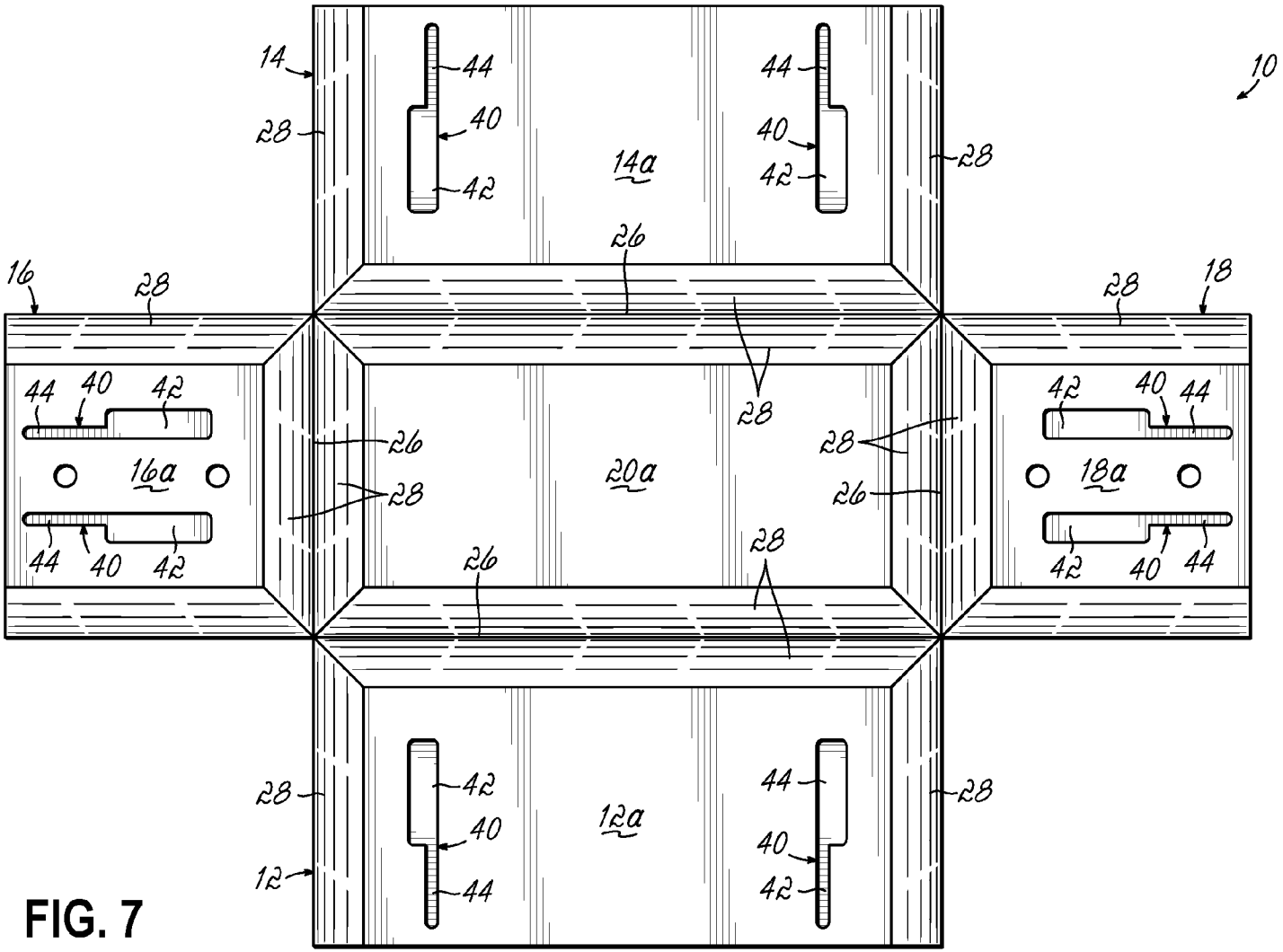
FIG. 7 is a top view of the embodiment illustrated in FIG. 6.

Structure 10 of FIG. 1 includes side panels 12 and 14, and end panels 16 and 18. Referring to FIGS. 6 and 7, structure 10 also includes a bottom panel 20, coupling the other panels together. As illustrated in FIG. 7, the structure is configured to initially be flat in an unassembled position, and thus, resembles a traditional paper blank. It can be shipped and stored efficiently in that way. Once the various adjacent panels are folded along respective fold lines in the assembled position, the adjacent panels come together to form the three-dimensional structure in FIG. 1.

Figure 8:
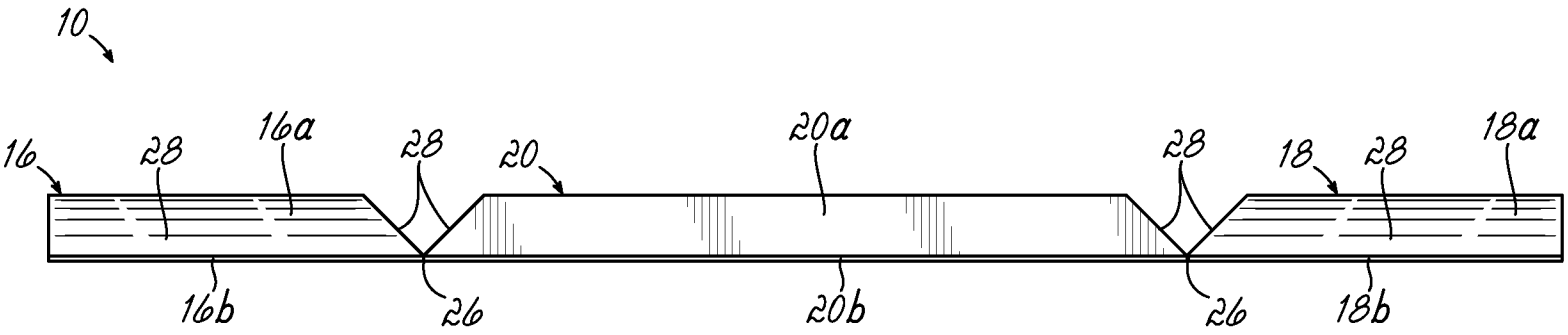
FIG. 8 is a side view of the embodiment illustrated in FIG. 7.
Figure 9:
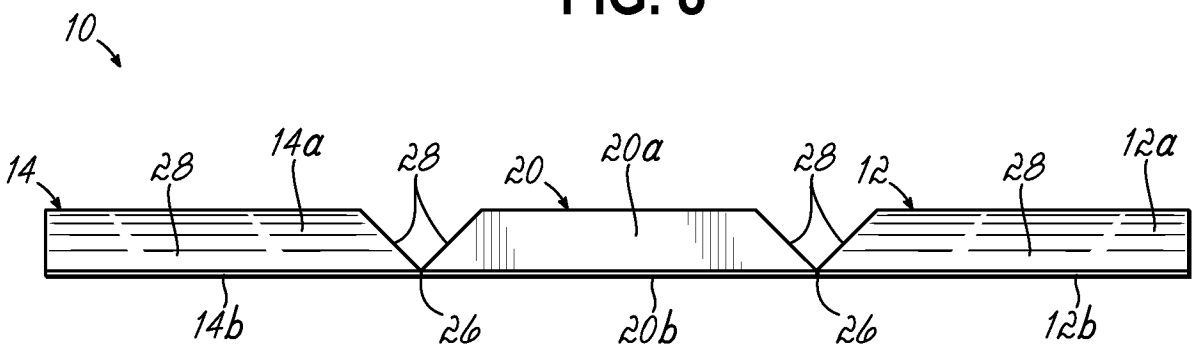
FIG. 9 is an end view of the embodiment illustrated in FIG. 7.

Each of the various panels 12-20 includes a foam core covered on one surface by a flexible skin. For example, the core might be formed of exploded polystyrene, whereas the skin might be a suitable flexible material, such as vinyl or synthetic paper. FIG. 6 shows an exploded view, including the various panels 12-20, as well as respective foam cores 12*a*, 14*a*, 16*a*, 18*a*, and 20*a*. Such cores are covered by respective flexible skin portions 12*b*, 14*b*, 16*b*, 18*b* and 20*b*. In one embodiment of the invention, the foam core of a panel may have a thickness in the range of ¼ inch to 5 inches, for example. As illustrated in FIG. 6, the flexible skin portions of the adjacent panels are continuous between the bottom panel and the side and end panels to form respective fold lines 26 at each edge of the bottom panel. In that way, the adjacent panels may be folded and brought together at a right angle along the fold lines. The panels abut the bottom panel, and the side panels then abut the end panels in the three-dimensional structure. FIGS. 8 and 9 illustrate side views showing more specifically the fold lines 26, and the continuous flexible skin portions between the adjacent panels.

Referring again to FIG. 6, the foam core of each panel 12-20 includes a mitered surface along at least one edge thereof. Specifically, the mitered surfaces are formed along the edges of the fold lines 26, and also along the abutting edges of adjacent side end panels, so that when the adjacent panels are brought together by being folded along the respective fold lines to form a three-dimensional structure, the mitered surfaces of the abutting edges of adjacent panels are configured to form a miter joint illustrated specifically by reference numeral 30 in FIGS. 10-14.

Referring to FIGS. 8 and 9, the respective mitered surfaces 28 are illustrated specifically along the fold lines 26, and also along side edges of the end and side panels. Structure 10 of the invention can lie flat, such as for shipment or storage, and then when the adjacent panels 12-20 are brought together by folding the panels with respect to the bottom panel along the respective fold lines, the mitered surfaces 28 ensure that the panels form a clean, right angle and miter joint 30, as illustrated at the bottom and at the corners of the assembled structure.

Structure 10 might be formed in various ways. In accordance with one embodiment of the invention, a flexible skin 24 might be applied to a foam core, such as with a suitable adhesive. The foam core may be in the form of a flat foam board of a suitable thickness (e.g., ¼ inch-5 inches). Then, the specific shape of the structure may be machined, such as by a CNC Machine, to the proper dimensions, depending upon the size and use of the assembled three-dimensional structure 10. For example, referring to FIG. 6, the foam board and skin might be cut to form effectively a cross shape, defining the bottom or center panel 20 and various adjacent panels 12-18. Then, V-grooves might be formed in the foam core board, as illustrated in FIGS. 8 and 9, to form the mitered surfaces 28 along the fold lines. Other mitered surfaces are also formed on the other abutting side edges of the panels. The top edges 15 of the structure might be left flat or square to the panels, such as to be abutted against a ceiling or wall surface. Any such machining would stop at the flexible skin 24 so as to leave the flexible skin continuous between the adjacent panels, and form respective fold lines 26, as illustrated in FIGS. 8 and 9. In that way, all of the various panels are held together when the structure is in an unassembled and flat position.

Figure 10:
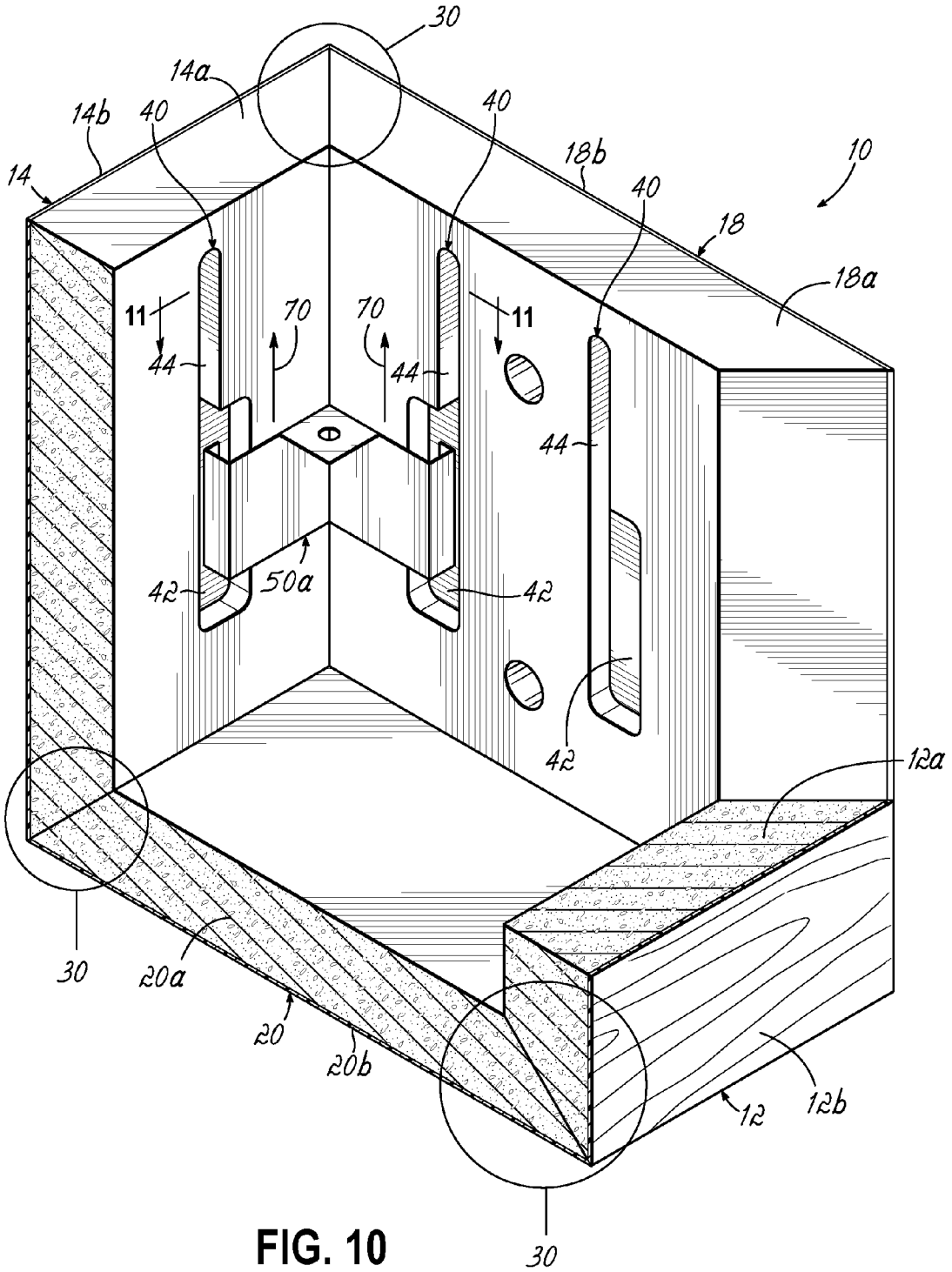
FIG. 10 is a partial cross-sectional view of the structure of the invention illustrated in the assembly.

In accordance with one aspect of the invention, brackets are utilized to hold the adjacent panels folded together in the assembled position. Specifically, referring to FIGS. 10-12, slots are formed in adjacent panels. The slots are formed adjacent to an abutting mitered surface and to a respective miter joint, as illustrated in FIGS. 10-14, for example. The slots of adjacent panels are positioned on opposite sides of the miter joint when the panels are folded and brought together. Referring to FIG. 10, slots 40 are shown formed in the panel cores 14, 18*a* adjacent the miter joints 30. The slots 40 are formed in the shape of keyhole slots having a wider section 42, in line with a more narrow section 44. As discussed further herein, the keyhole slots allow for engagement with brackets that are slid from wider section 42 to narrow section 44 so the brackets span the joints to hold adjacent panels together along their miter joints, and to thus, form bottom and side corners of the three-dimensional structure 10. In accordance with one aspect of the invention, a slot is formed on each side of the miter joint 30 between the side and end panels. The brackets engage a slot on each side of the respective miter joints to hold the joint together. Slots and brackets might also be used to span the joints between the bottom panel and other panels, but that generally would not be necessary.

Figure 2:
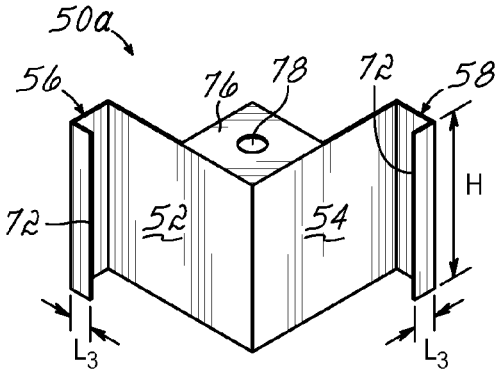
FIGS. 2-3 are perspective views of a bracket in accordance with one embodiment of the invention.
Figure 3:
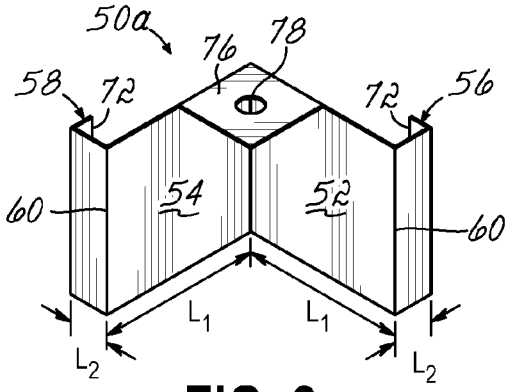
Figure 4:
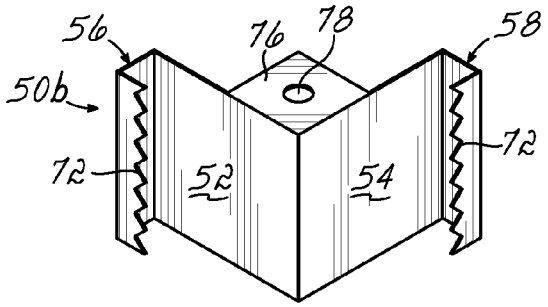
FIGS. 4-5 are perspective views of a bracket in accordance with an alternative embodiment of the invention.
Figure 5:
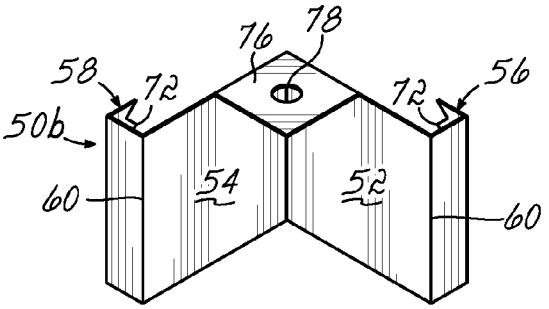
Figure 16:
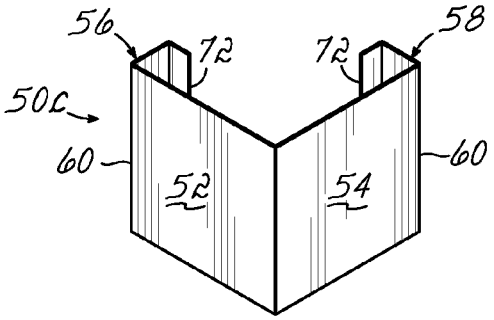
FIGS. 16-17 are perspective views of a bracket in accordance with the embodiment of the invention of FIG. 15.
Figure 17:
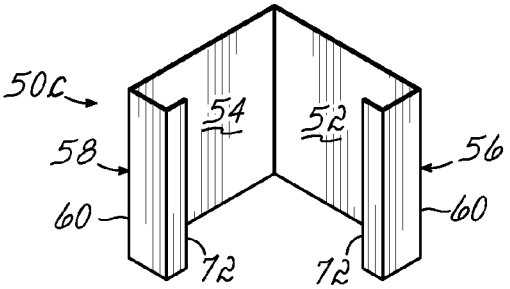
Figure 18:
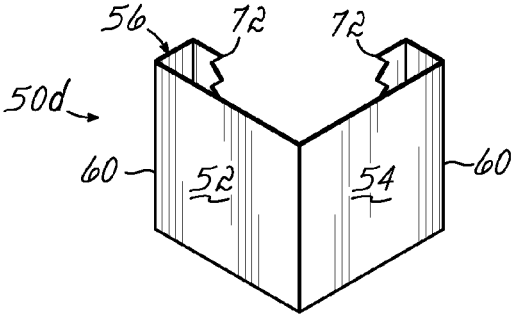
FIGS. 18-19 are perspective views of brackets for an alternative embodiment of the invention.
Figure 19:
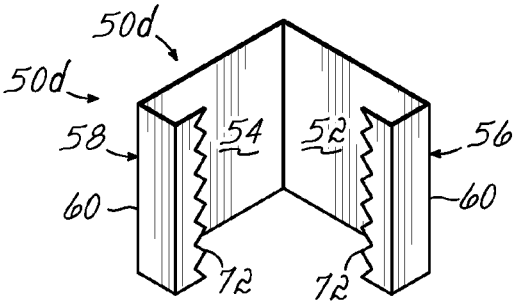

Referring to FIGS. 2-5, various perspective views of brackets in accordance with the invention are illustrated. FIGS. 2 and 3 illustrate perspective views of opposing sides of a bracket 50*a*. Similarly, FIGS. 4-5 illustrate perspective views of opposing sides of a bracket 50*b*. The brackets illustrated in FIGS. 2-5 are formed to engage the inside of the adjacent panels, and respectively, to span the inside corner formed by the various miter joints 30, as illustrated in FIG. 10. The brackets 50*a*, 50*b* include planar portions 52, 54 forming a right angle with each other. The brackets are configured to span a respective miter joint between adjacent panels. Each of the planar portions includes a hook portion 56, 58, respectively. The bracket may be formed by a piece of stamped metal that is appropriately sized and bent at a right angle, as illustrated in the figures. The hook portions may include additional right angle bends that bend at a right angle to the planar portions, and then back outwardly from the right angle of the bracket, to form the hook portions. An appropriate metal for such brackets might be 18-20 gauge metal, such as galvanized metal. However, the brackets might also be formed of injection-molded plastic. In one exemplary embodiment, the planar portions might have a length L of around 1 inch, and a height H of around 1¼ inches. The hook portions might be formed by bend sections having lengths of $L_2$ and ¼ inch and $L_3$ around ⅛ inch. Of course, other suitable dimensions might be used.

Each of the hook portions extends along an edge 60 of the planar portion, and is configured to slide into a respective slot 40 of a panel core when the bracket is positioned to span the miter joint. Both portions are also configured to grip the respective panel core in the slot for holding the spanned miter joints and panels together in a three-dimensional structure.

Figure 11:
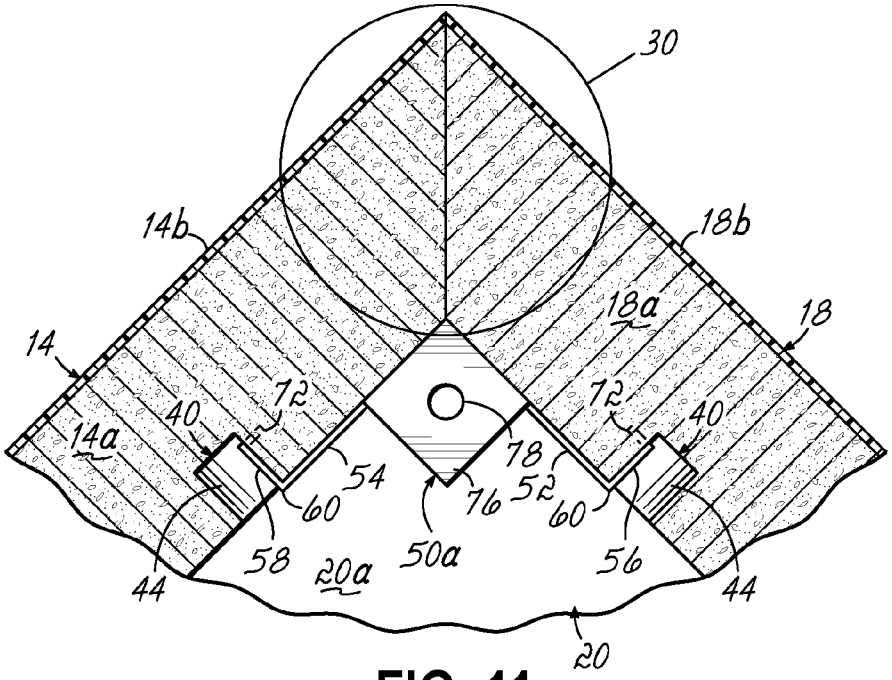
FIG. 11 is a cross-sectional view along lines 11-11 of FIG. 10.
Figure 13:
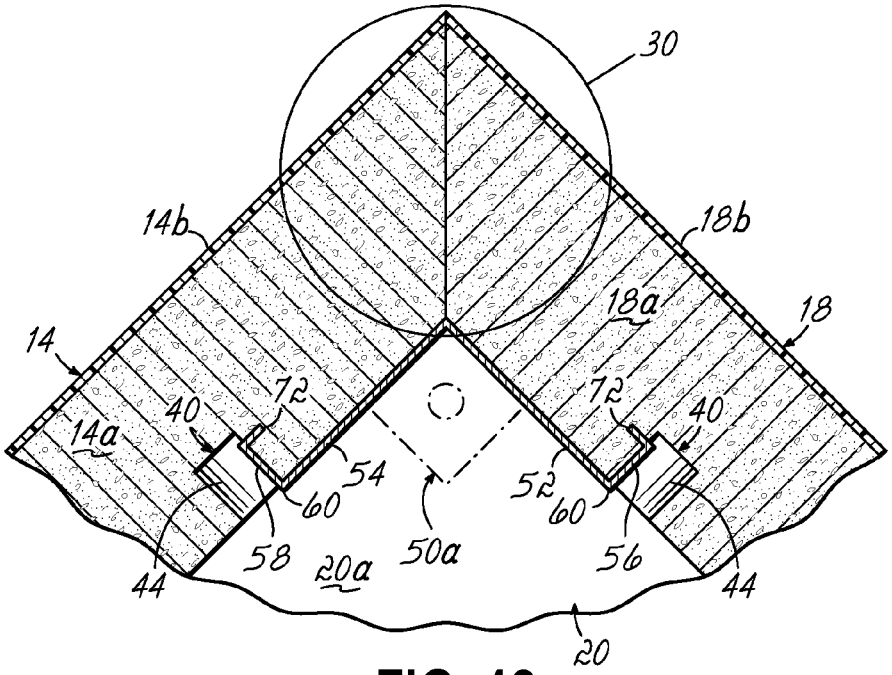
FIG. 13 is a cross-sectional view along lines 13-13 of FIG. 12.
Figure 12:
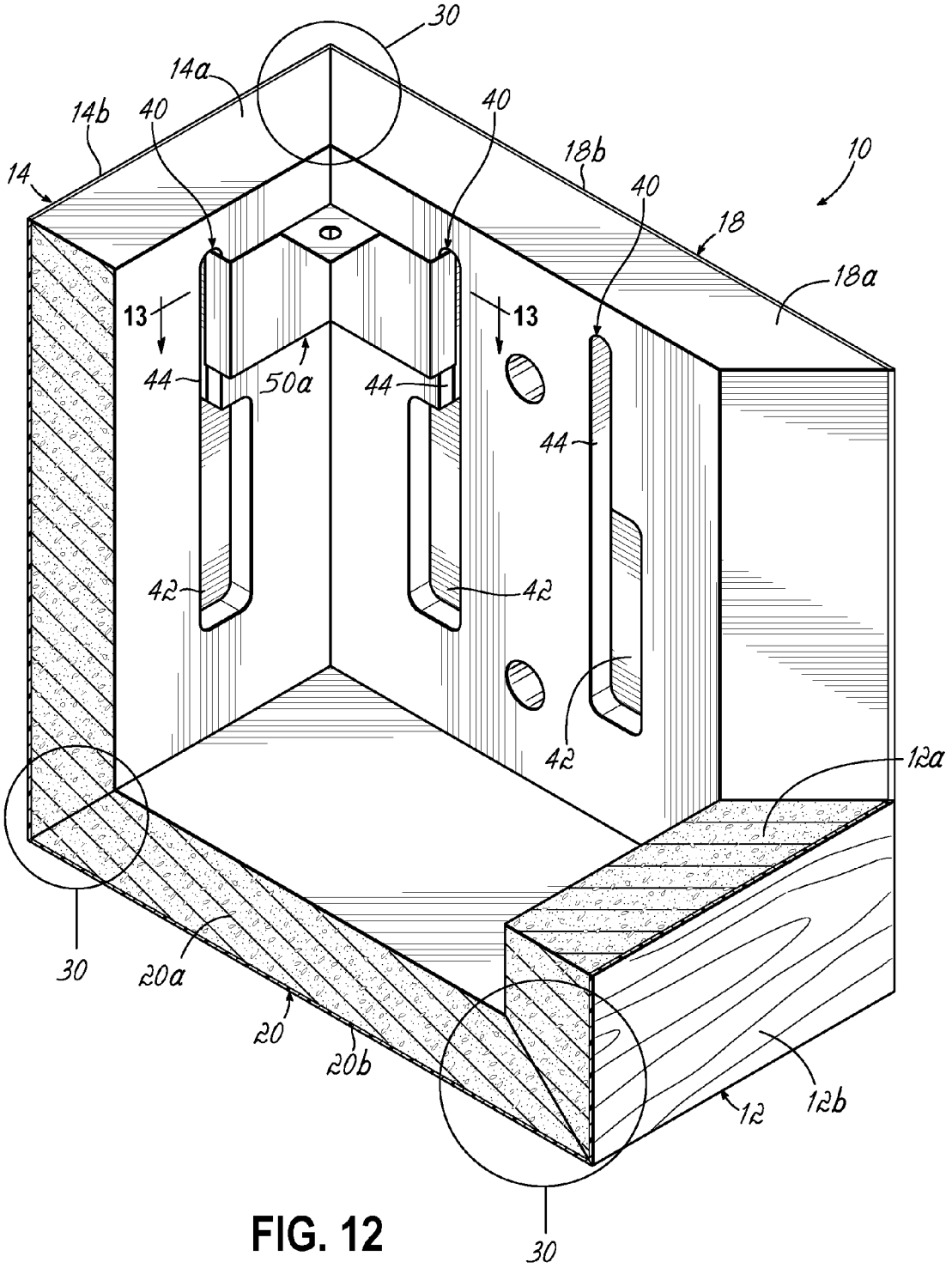
FIG. 12 is another cross-sectional view of an embodiment of the invention during assembly.

Referring to FIG. 10, when adjacent panels are brought together to form the three-dimensional structure 10 with appropriate miter joints, the slots 40 extend generally parallel to the miter joints 30 of the side and end panels. As noted above, one possible slot utilized in accordance with the present invention is a keyhole slot, wherein a wider section 42 is formed adjacent to a more narrow section 44. The hook portions 56, 58 of the bracket 50*a* illustrated in FIG. 10 are inserted in the wider section 42 of the keyhole slot 40, as the right angle formed by the bracket is positioned to span the miter joint 30. Bracket 50*a* is then moved in the direction of arrows 70, as illustrated in FIG. 10, to slide the hook portions into the more narrow section 44 of each slot. As illustrated, the bracket spans the miter joint and a hook portion on each side of the bracket engages an appropriate slot 40 in a panel. As shown in FIGS. 11-14, as the hook portion is slid into the narrow section 44 of the slots 40, an outer-most cutting edge 72 of each hook portion cuts into the foam material forming each panel core. As illustrated in FIG. 11, because of the shape of the keyhole slots 40, when the bracket 50*a* is initially spanned across the miter joint, the panel foam is not engaged by the hook portion. As illustrated in FIGS. 12 and 13, as the bracket 50*a* is slid upwardly into the narrow section 44 of the keyhole slot 40, the cutting edges 72 of each hook portion 56, 58 cut into the foam core of the panel, and thus, grip the panel core to hold the bracket 50*a* in position in an inside corner of the structure 10, thereby spanning the appropriate miter joint 30.

Figure 14:
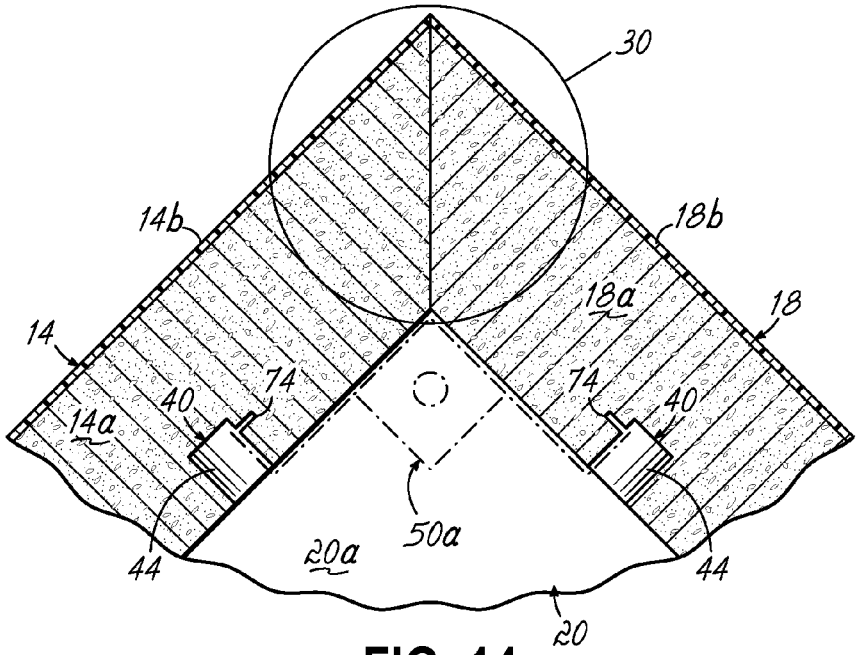
FIG. 14 is a cross-sectional view illustrating a bracket engagement in accordance with one aspect of the invention.

As illustrated in FIG. 14, the cutting edges 72 of the bracket hook portions will slice into the panel core, and effectively form a slot 74 that coincides with the cutting edge 72 of each hook portion. In that way, the hook portions robustly grip the foam cores, and hold the adjacent panels together at each miter joint to form the assembled three-dimensional structure 10. Additionally, an adhesive material or element might be used at the miter joints to further secure the panels together. For example, a double-sided adhesive tape might be used at each surface 28 of the panels to hold the miter joints together when the structure is assembled.

Thereby, the present invention provides a light three-dimensional structure that may be suspended from a ceiling or other structure as a decorative structure, as signage or a display structure, or for any other desirable purpose such as an architectural feature for the interior space of a building. The foam core lightweight material does not put a significant amount of weight stress on the suspending surface, such as a ceiling. Furthermore, because of its lightweight structure, it may be readily suspended utilizing the bracket 50*a*, 50*b*. As illustrated in FIGS. 2-5, the bracket may include a mounting portion 76 thereon, which may be stamped and bent into place during the formation of the bracket. The mounting portion may include an aperture 78, such as for securing a wire, string, or other support structure to suspend structure 10 from a ceiling surface. Of course, other mounting apparatus might be utilized for mounting the structure 10 from an appropriate surface.

The flexible skin utilized in an embodiment of the invention may contain graphics or various decorative patterns, depending upon the use of a structure 10. For example, in the illustrated embodiment, the flexible skin may be imprinted with a wood grain to give the impression of a wood structure, such as a soffit structure. Of course, other graphics and patterns might be utilized, depending upon the use of the invention.

In the illustrated embodiment, the three-dimensional structure is formed and held together by utilizing slots and brackets on an internal surface of the structure. In that way, the various brackets and slots are hidden by the overall three-dimensional structure. In the illustrated embodiments, appropriate slots and brackets are utilized on the various side and end panels 12-18 to hold the three-dimensional structure in an assembled position. Generally, with such a construction, it would not be necessary to incorporate brackets engaging bottom panel 20. However, such an arrangement could be made for an even more robust construction and slots and brackets might be used in the miter joints along the fold lines.

Figure 15:
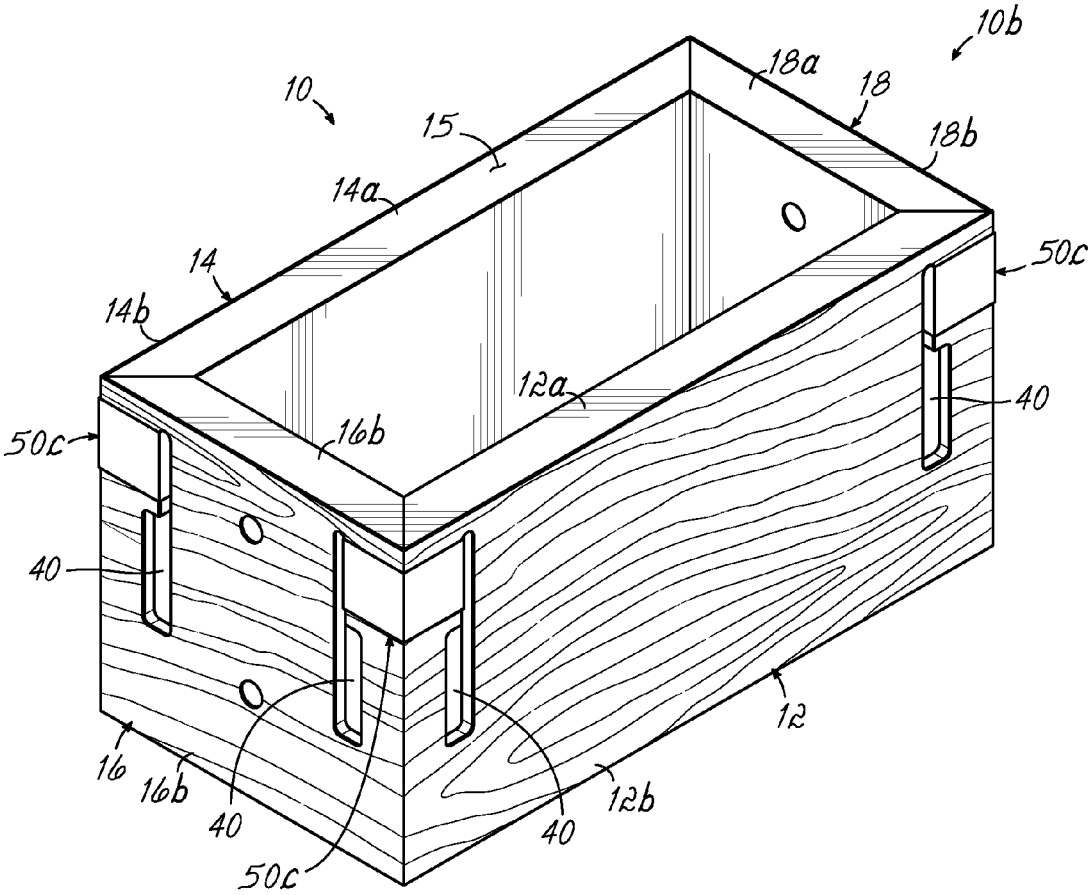
FIG. 15 is a perspective view of an alternative embodiment of the invention.

While one embodiment of the invention discussed herein incorporates slots on the internal side of each panel to be hidden when the structure is assembled to form a three-dimensional structure, an alternative embodiment might incorporate such slots and respective brackets proximate the outside surface. Referring to FIGS. 15-19, the structure may be formed to include appropriate slots 40 on the outside surface of each of the panels of the structure. That is, when the adjacent panels are brought together along respective fold lines to form the various miter joints at each corner of the structure, the slots and brackets are implemented on the outside of those miter joints and corners between adjacent end and side panels similar to the illustrated embodiments of FIGS. 1-14. In particular, as illustrated in FIG. 15, an appropriate slot 40 is formed to extend generally parallel to each miter joint at a side or end corner of the structure. The appropriate brackets 50*c*, 50*d*, as illustrated in FIGS. 16-19, are formed similarly to other brackets discussed herein having planar portions forming a right angle with each other, and configured to span a miter joint between adjacent panels. However, the hook portions are formed to hook inwardly with respect to each bracket, rather than outwardly, as illustrated in FIGS. 2-5. In that way, each hook portion is configured to slide in the external slots when the bracket is positioned to span the outside of the miter joint, and can thus, grip the respective panel core to hold the spanned miter joint and panels together in the three-dimensional structure, as illustrated in FIG. 15. The brackets 50*c* are positioned in each of the slots 40, such as keyhole slots, and then slid to the narrow sections of the keyhole slots, to cut into the panel cores and thereby grip the panel cores and hold the panels together in the miter joint.

Figure 20:
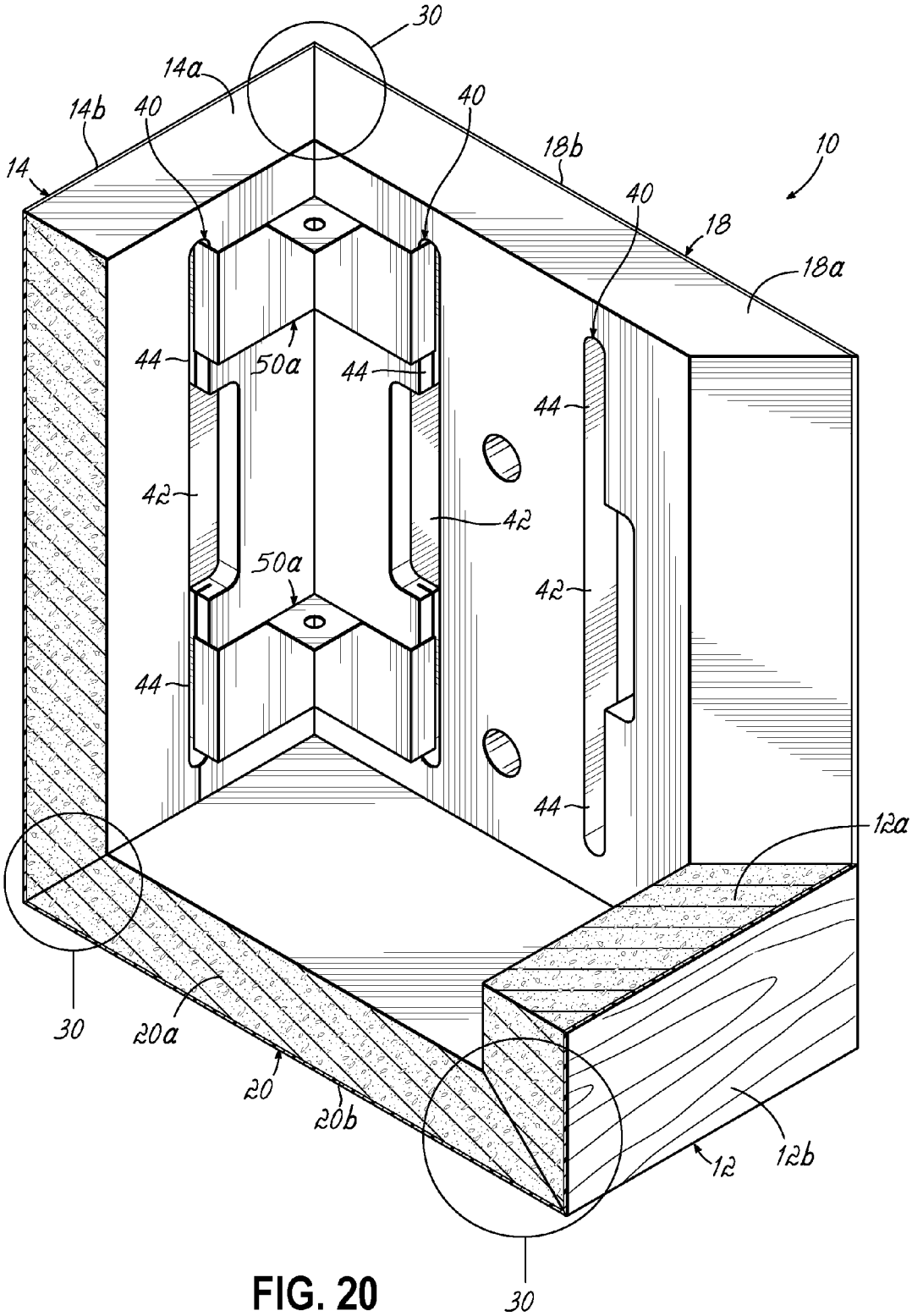
FIG. 20 is a cross-sectional view of an alternative embodiment of the invention.

FIG. 20 illustrates an alternative embodiment of the invention with respect to the embodiment illustrated in FIGS. 1-14. More specifically, the structure may be dimensioned such that it is desirable to incorporate a plurality of brackets along the various miter joints. To that end, the structure 10*c* of FIG. 20 illustrates slots 40*a*, wherein the thin portions 44 of the slot extend on either side of the wider portion 42. In that way, keyhole slots are formed end-to-end, one toward the top of the miter joint in the structure 10*c*, and one toward the bottom of the miter joint. Accordingly, as will be understood, the invention is not limited to a particular number of slots or brackets. Rather, the number of brackets and slots implemented for constructing a three-dimensional structure will depend upon the dimensions of the various panels implemented in the structure.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A structure configured to be flat in an unassembled position and to form a three-dimensional structure in an assembled position, comprising:

a plurality of adjacent panels coupled together along fold lines;

each panel including a foam core covered on one surface by a flexible skin, the flexible skin being continuous between the adjacent panels that are coupled together for forming a respective fold line for the adjacent panels to be brought together at a right angle to each other along the fold line;

the foam core of each panel including a mitered surface along at least one edge thereof, the mitered surfaces of adjacent panels configured to form a miter joint when the panels are brought together;

at least one keyhole slot formed in at least two adjacent panel cores proximate to the respective mitered surface of the panel core, each keyhole slot including a wider section and a narrow section and the keyhole slots of adjacent panels positioned on opposite sides of a formed miter joint when the at least two adjacent panels are brought together;

at least one bracket having two portions forming a right angle with each other and configured to span a miter joint between adjacent panels, each bracket portion including a respective hook portion extending along an edge thereof to form opposing hook portions, the opposing hook portions configured to engage the wider sections of respective keyhole slots on opposite sides of the formed miter joint and slide into the narrow sections of the respective keyhole slots of adjacent panel cores when the bracket spans the miter joint, at least one hook portion of a bracket including a cutting edge configured for cutting into a panel core and the hook portions further configured to grip the respective panel cores in the narrow sections of the keyhole slots for holding the spanned miter joint and panels together in a three-dimensional structure.

2. The structure of claim 1 wherein the keyhole slots are formed on an internal surface of the panel cores.

3. The structure of claim 1 wherein the keyhole slots are formed on an outside surface of the panel cores.

4. The structure of claim 1 wherein the keyhole slots include a plurality of narrow sections for receiving a plurality of brackets.

5. The structure of claim 1 wherein the at least one bracket includes a mounting portion for mounting the structure to a support surface.

6. The structure of claim 1 wherein the plurality of adjacent panels includes a center panel having edges for coupling other adjacent panels along respective fold lines, the panels being brought together around the center panel to form a box structure.

7. The structure of claim 1 wherein the flexible skin is formed of at least one of vinyl or synthetic paper.

8. The structure of claim 1 wherein the foam core is formed of polystyrene.

9. The structure of claim 1 wherein the foam core has a thickness in the range of ¼ inch to 5 inches.

10. A three-dimensional structure, comprising:

a plurality of adjacent panels coupled together at right angles with respect to each other, each panel including a foam core and coupled together along fold lines with at least one additional panel;

the adjacent panels all covered by a flexible skin, the flexible skin being continuous between the adjacent panels to form the respective fold lines between panels;

the foam cores of adjacent panels forming a miter joint between the panels;

a keyhole slot formed in each of at least two adjacent panel cores proximate to the miter joint between the panels, the slots being positioned on opposite sides of a formed miter joint and having a wider section and a narrow section;

at least one bracket having two portions forming a right angle with each other and spanning a miter joint in the structure, the bracket including opposing hook portions engaging the narrow sections of respective keyhole slots in the panel cores on opposite sides of the formed miter joint, at least one hook portion of a bracket including a cutting edge configured for cutting into a panel core and the hook portions configured for gripping the respective panel cores in the narrow sections of the keyhole slots for holding the panels together in the three-dimensional structure.

11. The structure of claim 10 wherein the keyhole slots are formed on an internal surface of the panel cores.

12. The structure of claim 10 wherein the keyhole slots are formed on an outside surface of the panel cores.

13. The structure of claim 10 wherein the keyhole slots include a plurality of narrow sections for receiving a plurality of brackets.

14. The structure of claim 10 wherein the at least one bracket includes a mounting portion for mounting the structure to a support surface.

15. The structure of claim 10 wherein the plurality of adjacent panels includes a center panel having edges and adjacent panels along respective fold lines at the edges of the center panel wherein the three-dimensional structure forms a box structure.

16. The structure of claim 10 wherein the flexible skin is formed of at least one of vinyl or synthetic paper.

17. The structure of claim 10 wherein the foam core is formed of polystyrene.

18. The structure of claim 10 wherein the foam core has a thickness in the range of ¼ inch to 5 inches.

* * * * *